US005231439A

United States Patent [19]

Takahashi et al.

[11] Patent Number: 5,231,439

[45] Date of Patent: Jul. 27, 1993

[54] PHOTOGRAPHIC FILM HANDLING METHOD

[75] Inventors: Koichi Takahashi; Ken Kawada; Kazuo Shiota, all of Kanagawa, Japan

[73] Assignee: Fuji Photo Film Co., Ltd., Kanagawa, Japan

[21] Appl. No.: 739,374

[22] Filed: Aug. 2, 1991

[30] Foreign Application Priority Data

Aug. 3, 1990 [JP] Japan ..... 2-206198
Jul. 12, 1991 [JP] Japan ..... 3-198485

[51] Int. Cl.[5] ..... G03D 17/00

[52] U.S. Cl. ..... 354/313; 354/314; 354/320; 354/321; 354/341

[58] Field of Search ..... 354/275, 318, 314, 317, 354/313, 319, 323, 324, 340, 341; 355/77, 133; 242/71.1, 71.2, 71.4

[56] References Cited

U.S. PATENT DOCUMENTS 3,623,417 11/1971 Eloranta et al. ..... 354/317
3,641,910 2/1972 Smith ..... 354/319
4,375,324 3/1983 Holmes ..... 354/318 X
4,832,275 5/1989 Robertson ..... 354/275 X
4,834,306 5/1989 Robertson et al. ..... 242/71.1
4,843,412 6/1989 Uchiyama et al. ..... 354/275
4,846,418 7/1989 Fairman ..... 354/275 X
5,083,155 1/1992 Kataoka et al. ..... 354/275
5,093,686 3/1992 Shigaki ..... 355/77

FOREIGN PATENT DOCUMENTS 0330069 8/1989 European Pat. Off. .
2717309 11/1977 Fed. Rep. of Germany .
4038661 6/1991 Fed. Rep. of Germany .
2124564 5/1990 Japan .

*Primary Examiner*—D. Rutledge
*Attorney, Agent, or Firm*—Sughrue, Mion, Zinn, Macpeak & Seas

[57] ABSTRACT

In a photographic film cassette, rotation of a spool in a direction of unwinding a photographic film causes a film leader to advance to an outside of a cassette shell. An exposed film is drawn out of the cassette shell after advancing the film leader for developing the exposed film in a state with a film trailer attached to the spool so as to keep the cassette shell reusable. The exposed film is wound up into the cassette shell after development. After development, the spool is rotated in the unwinding direction in a printer in order to advance the film leader outward such that the exposed film can then be drawn out of the cassette shell frame by frame for subjecting the developed film to printing in a state with the film trailer attached to the spool. Thereafter, the spool is rotated in a direction of winding up the developed film for containing the exposed film in the cassette shell.

26 Claims, 13 Drawing Sheets

PHOTOGRAPHIC FILM HANDLING METHOD

BACKGROUND OF THE INVENTION

1. Field of the Invention

The present invention relates to a method of handling photographic film and a film cassette for containing the same, and more particularly to a photographic film handling method in which a cassette shell for containing unexposed film is reused.

2. Background 135 mm photographic film has been widely used in recent years in both compact cameras and single-use cameras. Therefore, the consumption of film contained in film cassettes is progressively increasing. The negative photofinishing process consists of a film developing process, a printing process and a paper developing process. There are simplified photofinishing systems including mini-laboratory equipment capable of continuously effecting the series of processes for the purpose of simple and rapid film developing operations. Additionally, there has been proposed a film cassette in which rotation of a spool in a direction of unwinding the photographic film causes a film leader to be fed outside the cassette shell, as described in U.S. Pat. Nos. 4,832,275, 4,834,306, and 4,846,418, Japanese Patent Laid-open Publication No. 2-124564, and a number of Japanese patent applications filed by the present applicant.

When a laboratory receives an order from a customer for processing a photographic film after exposure, an exposed film is drawn out of a cassette shell, developed, cut into film sheets of a predetermined length (e.g. of six image frames), inserted in a film sheath, and returned to the customer together with photoprints printed from the developed film. However, it is inconvenient to store and handle the cut film sheets because they require a relatively large space. This procedure is also inefficient because a posterior process is necessary to insert the film sheets in the film sheath after the film has been cut into the shorter film pieces. Further, reprinting of developed film cannot be performed efficiently because separated film pieces are spliced together in elongation therefor.

Conventionally, a photofinisher unwinds and separates an exposed film from the cassette shell for developing and printing, and throws the emptied cassette shells away. A great number of emptied cassette shells have been thrown away as industrial waste, which is undesirable in view of economy of resources and protection of the environment.

SUMMARY OF THE INVENTION

It is therefore an object of the present invention to provide a photographic film handling method by which efficiency in photofinishing processes is improved.

It is another object of the present invention to provide a photographic film handling method in which industrial waste is reduced by reusing the cassette shell after developing photographic film without throwing it away.

In order to achieve the above and other objects and advantages of this invention, a photographic film cassette is handled in which cassette rotation of a spool in a direction of unwinding a photographic film causes a film leader to advance outside of the cassette shell. The exposed film is thereafter drawn out of the cassette shell for developing the exposed film in such a manner that the film trailer remains attached to the spool so as to allow the cassette shell be to be reused. Efficiency in photofinishing processes is improved by the method according to the present invention.

According to a preferred embodiment, the exposed film is wound up into the cassette shell after development. The spool is then rotated in the unwinding direction in a printer in order to advance the film leader out of the cassette shell. The exposed film is drawn out of the cassette shell frame by frame after advancing the film leader for subjecting the exposed film to printing in a state with the film trailer attached to the spool. Thereafter, the exposed film is rewound into the spool by rotating the spool in the wind-up direction so that the exposed film is contained in the cassette shell. Industrial waste is reduced by reusing the cassette shell after the developing of the photographic film without throwing it away. Not only a photofinisher but also a customer can easily handle a developed film stored in the cassette shell.

According to another preferred embodiment, after development of the exposed film, the spool is rotated to wind the exposed film such that the film is contained in the cassette shell. Thereafter, the spool is rotated in the unwinding direction in a slide-mounting machine in order to advance the film leader out of the cassette shell. The exposed film is drawn out of the cassette shell frame by frame and cut into respective film pieces of image frames which are mounted on slide mounts.

According to a further preferred embodiment, the spool is rotated in the unwinding direction to advance the film leader of the photographic film out of the cassette shell after exposure. The photographic film is drawn out until a first end of a connecting sheet is disposed outside the cassette shell. The connecting sheet is wound beforehand on the spool together with the photographic film in a state with the first end connected to the film trailer and with an opposite second end fixed on the spool in order to connect the photographic film to the spool. The photographic film is separated from the connecting sheet for development. Thereafter, the photographic film is reconnected to the first end of the connecting sheet drawn out of the cassette shell. The spool is then rotated in the winding-up direction for drawing the developed film into the cassette shell together with the connecting sheet.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS OF THE PRESENT INVENTION

Figure 1:
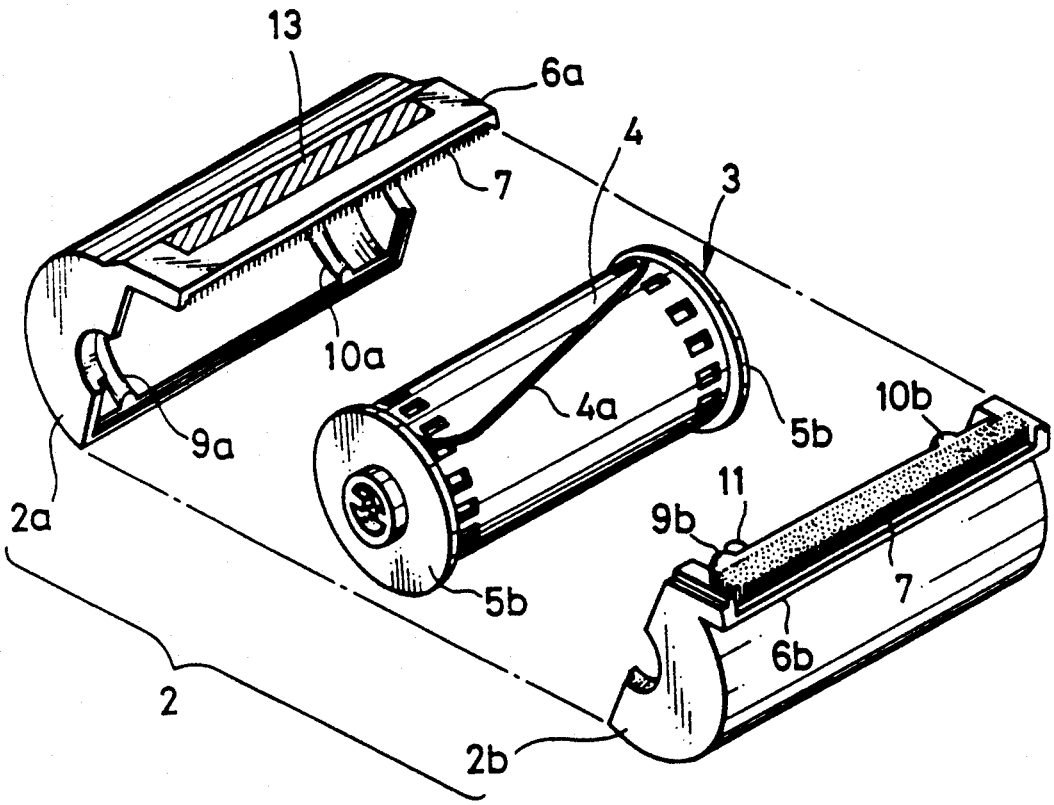
FIG. 1 is an exploded perspective view illustrating a photographic film cassette to be handled in the present invention.
Figure 2:
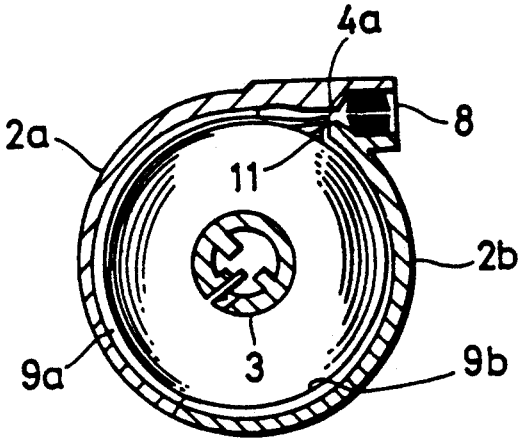
FIG. 2 is a sectional view illustrating the film cassette illustrated in FIG. 1.

In FIGS. 1 and 2 illustrating a photographic film cassette to be handled in the present invention, the film cassette consists of a cassette shell 2 including upper and lower shell halves 2*a* and 2*b* made of plastic, a spool 3 rotatably supported therebetween, and a photographic film 4 wound in a roll between flanges 5*a* and 5*b* of the spool 3 in a state with a film trailer arrested on the spool 3.

Upper and lower tongues 6*a* and 6*b* are respectively integrally formed on the shell halves 2*a* and 2*b*. A light shielding fabric or plush 7, well-known in the art, is attached to the inside of the tongues 6*a* and 6*b*, and shields light from entering into a film passageway 8 defined between the tongues 6*a* and 6*b*. Ridges 9*a* and 9*b*, and 10*a* and 10*b* are respectively formed on the inside surfaces of both shell halves 2*a* and 2*b*, and are in contact with the outermost revolution of the photographic film 4 wound in a roll so as to prevent the photographic film 4 from loosening. A separating claw 11 is formed in the innermost position of the lower tongue 6*b* near the ridge 9*b*, and is in contact with the outermost revolution of the photographic film 4 slightly interior to film perforation regarding the widthwise direction of the photographic film 4. The separating claw 11 is designed to separate a leading end portion 4*a* of a film leader from the roll of film 4. The outside surface of the upper tongue 6*a* is provided with a magnetic recording portion 13 for magnetically recording data therein and reading data therefrom.

In the present film cassette, the photographic film 4 is completely wound in the cassette shell 2 up to the leading end portion 4*a*. However, clockwise rotation of the spool 3 can cause the leading end portion 4*a* to advance out through the film passageway 8. Specifically, is because the film is prevented from loosening by the ridges 9*a*, 9*b*, 10*a* and 10*b*, the photographic film 4 in the roll is rotated clockwise when the spool 3 is rotated clockwise. Further rotation of spool 3, in a state with the leading end portion 4*a* located in the innermost position of the film passageway 8, causes the separating claw 11 to separate the leading end portion 4*a* to guide it to the film passageway 8, so that the leading end portion 4*a* is advanced to the outside of the cassette shell 2.

When the film cassette is loaded in a camera with the leading end portion 4*a* completely wound in the cassette shell 2, the leading end portion 4*a* is advanced by rotating the spool 3 with a film feeding mechanism of the camera. Thus the loading of the film cassette is simplified without the necessity of protruding the film leader outside the cassette shell as required with a conventional film cassette. After taking photographs with the camera, the exposed film 4 is wound up in the cassette shell 2 using a rewinding mechanism in the camera. The film cassette is then unloaded from the camera and is forwarded to a photolaboratory through the photofinishing agent.

Figure 3:
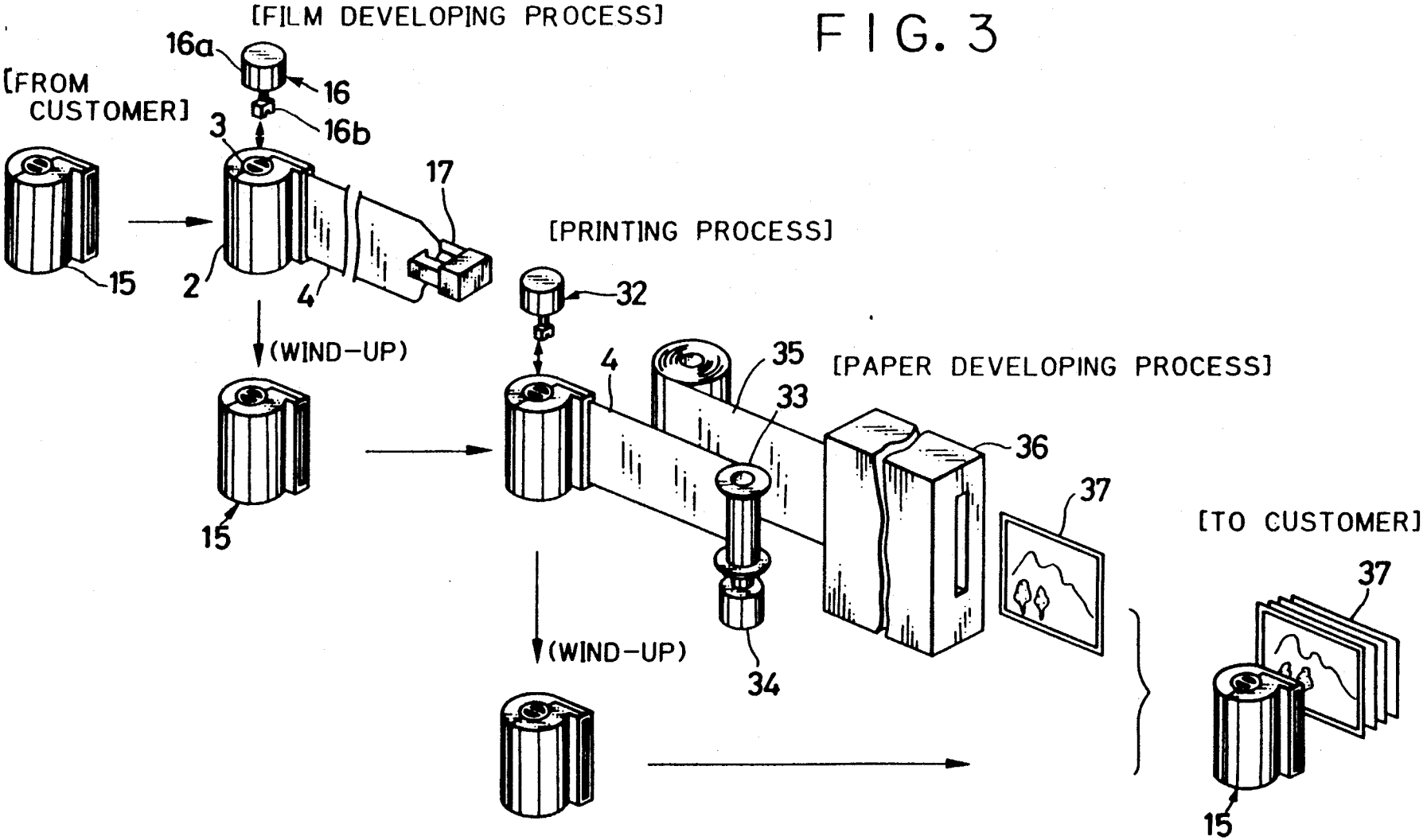
FIG. 3 is an schematical view illustrating a photofinishing system for processing the film cassette illustrated in FIG. 1.

Such a film cassette thus forwarded to a photofinisher is treated according to the procedures schematically illustrated in FIG. 3, in which the film cassette 15 contains the exposed film initially before development in light-tight fashion. The film cassette 15 is subjected to a film developing process, in which a spool rotating device 16, including a motor 16*a* and a fork 16*b*, rotates the spool 3 in the unwinding direction so as to advance the leading end portion 4*a* of the film. When advanced a predetermined degree, the leading end portion 4*a* is grasped by a catcher 17, whereupon the spool rotating device 16 is removed from the spool 3.

When grasping the leading end portion 4*a* with the catcher 17, the catcher 17 is moved away from the cassette shell 2 so as to draw the exposed film 4 completely therefrom. The film trailer of the exposed film 4 is kept attached to the spool 3. The exposed film 4 is then conveyed in the film developing machine together with the cassette shell 2. The exposed film 4 passes through well-known processing tanks such as a developing tank, a fixing tank, a rinsing tank, and is thereafter dried.

Figure 4A:
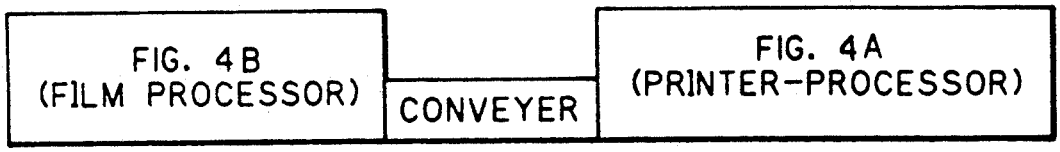
FIGS. 4A–4C illustrate the photofinishing system illustrated in FIG. 3 in combination with a film processor and a printer-processor.
Figure 4B:
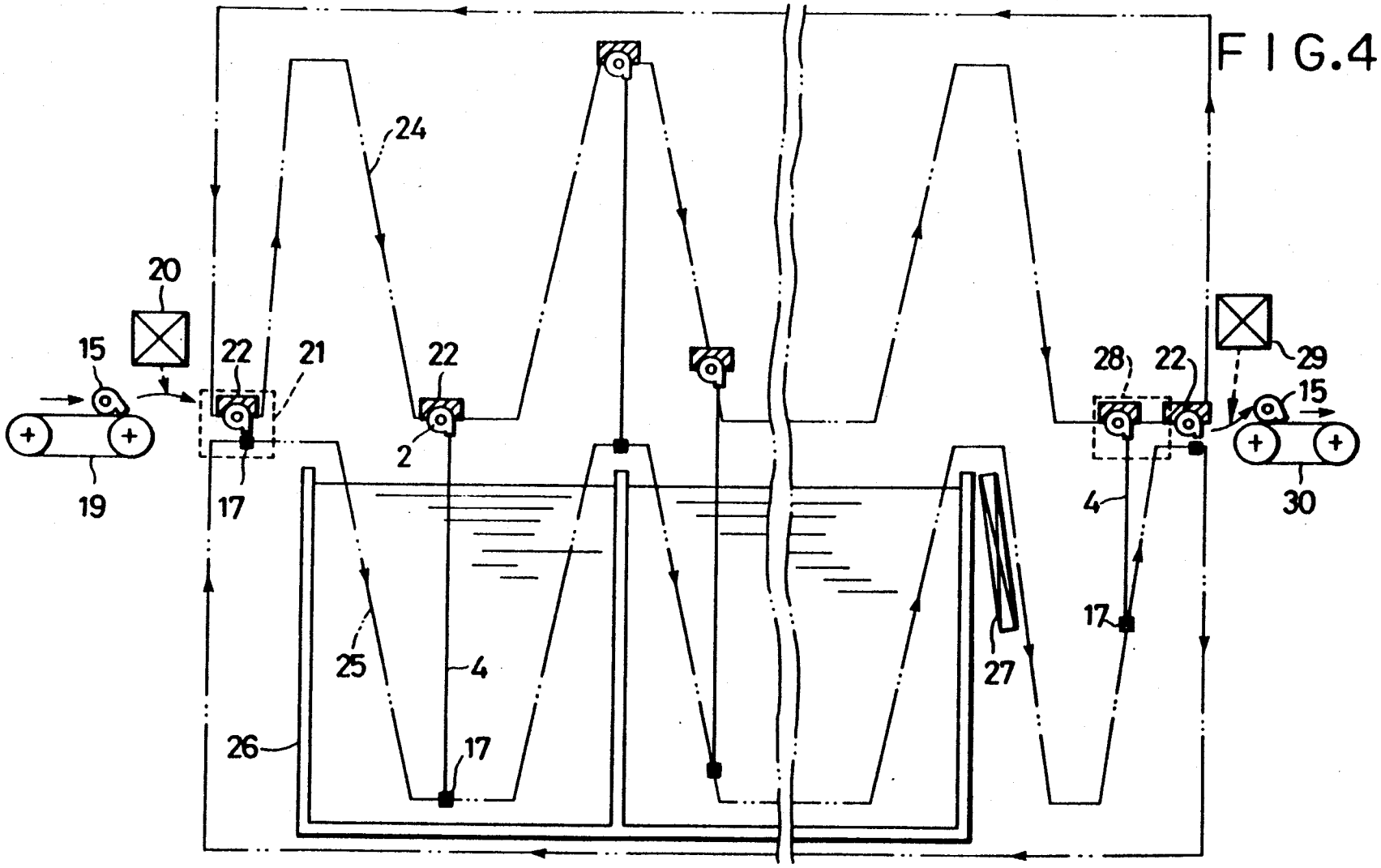

In more detail, referring to FIGS. 4A and 4B, illustrating schematically the film processor, after exposure, the film cassette 15 is conveyed in a darkroom by a conveyer belt 19, and positioned in a drawing-out station 21 by a transporter 20. The cassette shell 2 is supported in a cassette holder 22 in the drawing-out station 21, where the spool rotating device 16 is coupled with the spool 3. In the drawing-out station 21, the catcher 17 is disposed just below the tongues 6*a* and 6*b* of the cassette shell 2. The spool rotating device 16 is operated to advance the leading end portion 4*a* outside the cassette shell 2. The spool rotating device 16 is removed from the spool 3 when the catcher 17 catches the leading end portion 4*a*.

After the leading end portion 4*a* is grasped by the catcher 17, the cassette holder 22 and the catcher 17 simultaneously move along a passageway 24 and a passageway 25, respectively. When the cassette holder 22 is raised during a horizontal movement of the catcher 17, the exposed film 4 is drawn out of the cassette shell 2.

The distance between the cassette holder 22 and the catcher 17 is maintained constant. In this manner, the exposed film 4 passes in cooperation of the cassette shell 2 through processing tanks 26 such as the color developing tank, the bleaching/fixing tank, the rinsing tank, and the stabilizing tank to develope the photographic film 4.

The thus developed film 4 is dried with heated air blown by a dryer 27, and thereafter positioned in a wind-up station 28, where the leading end portion 4*a* is released from the grasp of the catcher 17. A spool rotating device, similar to the spool rotating device 16 discussed above, is coupled with the spool 3, and rotates the spool in the direction of wind-up so as to rewind the film 4 into the cassette shell 2. A transporter 29 removes the film cassette 15 from the cassette holder 22, and transports it to a conveyer belt 30 for discharge.

Figure 4C:
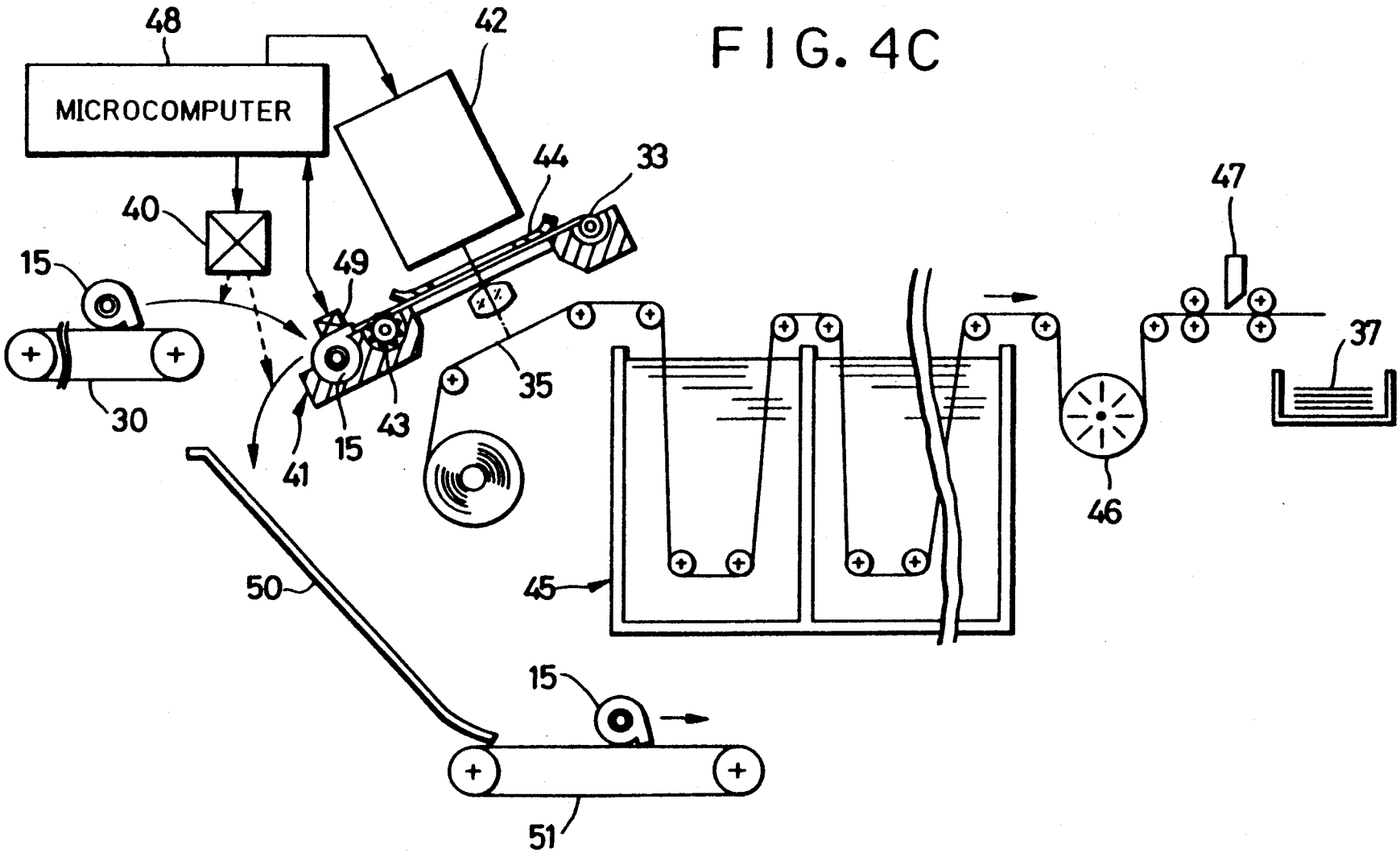

The film cassette 15 is subjected to a printing process after the developing process. The spool 3 is rotated in the unwinding direction by a spool rotating device 32 in the printing process in the same manner as the in the beginning of the developing process in order to advance the leading end portion 4a outside of the cassette shell 2. As illustrated in FIG. 4C, the leading end portion 4a, as advanced, is taken up and fed by a sprocket 43, described in detail below, and wound about a reel 33. The reel 33 is driven by a motor 34 to feed the developed film 4 frame by frame as illustrated in FIG. 3. Each image frame on the developed film 4 is successively printed onto photographic paper or color paper 35.

After printing, the color paper 35 is developed in a paper processor section 36 of a printer-processor having a color developing tank, a bleaching/fixing tank, and a rinsing tank, and cut frame by frame into photoprints 37. Upon completion of printing all the image frames recorded on the developed film 4, a motor of the spool rotating device 32 is rotated is rotated in reverse to rewind the developed film 4 from the reel 33 into the cassette shell 2 at the end of the printing process. The film cassette 15 containing the developed film 4 is returned to its customer together with the photoprints 37.

Referring to FIG. 4C, illustrating a printer-processor for performing the above printing process and the paper developing process, the film cassette 15 conveyed by the conveyer belt 30 after the developing process is transported by a transporter 40 and positioned in a cassette holder 41. The cassette holder 41 is provided with the spool rotating device 32 which causes the leading end portion 4a to advance.

The sprocket 43 is provided on the cassette holder 41. The leading end portion 4a advanced from the cassette shell 2 is fed toward the reel 33 under a film mask 44 by the sprocket 43 and arrested on the reel 33. The motor 34 is driven to wind the developed film 4 frame by frame on the reel 33 each time that a light source unit 42 causes the respective image frames to be printed on the color paper 35. The color paper 35, after each exposure, is transported when the developed film 4 is fed frame by frame. The exposed paper 35 is successively passed through processing tanks 45 constituted of a color developing tank, a bleaching/fixing tank and the like, dried in a drying drum 46, and cut by a cutter 47 frame by frame resulting in the photoprints 37.

The light source unit 42 illuminates image frames on the developed film 4 with printing light, of which the intensity and the color are regulated in accordance with images frames. The density and tone of the image frame positioned in the printing position are measured by a color scanner, from which measured data are supplied to a microcomputer 48. The microcomputer 48 supplies the light source unit 42 with control data corresponding to the data supplied from the color scanner, and regulates the printing light of the light source unit 42.

The control data supplied to the light source unit 42 are written in the magnetic recording portion 13 on the cassette shell 2 by means of a magnetic head 49 capable of recording/reading data. If the customer owning the film cassette 15 places an order for reprinting, data are read out of the magnetic recording portion 13 for regulating the light source unit 42 according thereto, so that it is possible to reprint the image frames under the same condition as the initial photoprints.

It is noted that an IC memory instead of the magnetic recording portion 13 may be mounted on the cassette shell 2 for storing control data. Additionally, a data recording area may alternatively be formed on the photographic film 4 for writing control data on the photographic film 4. Such a data recording area can be a magnetic material layer formed on a predetermined portion of the photographic film 4. It is also noted that the magnetic recording portion, an IC memory or a data recording area may store ID data for identifying the photographic film, and exposure data regarding conditions in recording image frames on the photographic film.

When all the image frames on the developed film 4 are printed, the motor of the spool rotating device 32 is rotated in reverse to again wind the developed film 4 into the cassette shell 2. The film cassette 15 is transported to a passage 50 by the transporter 40 and sent to a conveyer belt 51.

By use of a system for processing film cassettes, the photographic film 4 is handled in constant combination with the cassette shell 2 after taking photographs with a camera until returning the developed film 4 with photoprints. It is possible to use the cassette shell 2 as a container for returning the developed film 4 without the need of cutting the developed film 4 into film pieces generally constituted of every six images. The cassette shell 2 is in perfect correspondence with the photographic film 4, so that it is possible by recording ID number and exposure conditions at the printing time therein to classify the orders for printing and reprinting and to improve efficiency in reprinting operation. There is no need to throw away the cassette shell 2 so that no pollution of industrial waste is caused even with plastics molded into the cassette shell.

Figure 5:
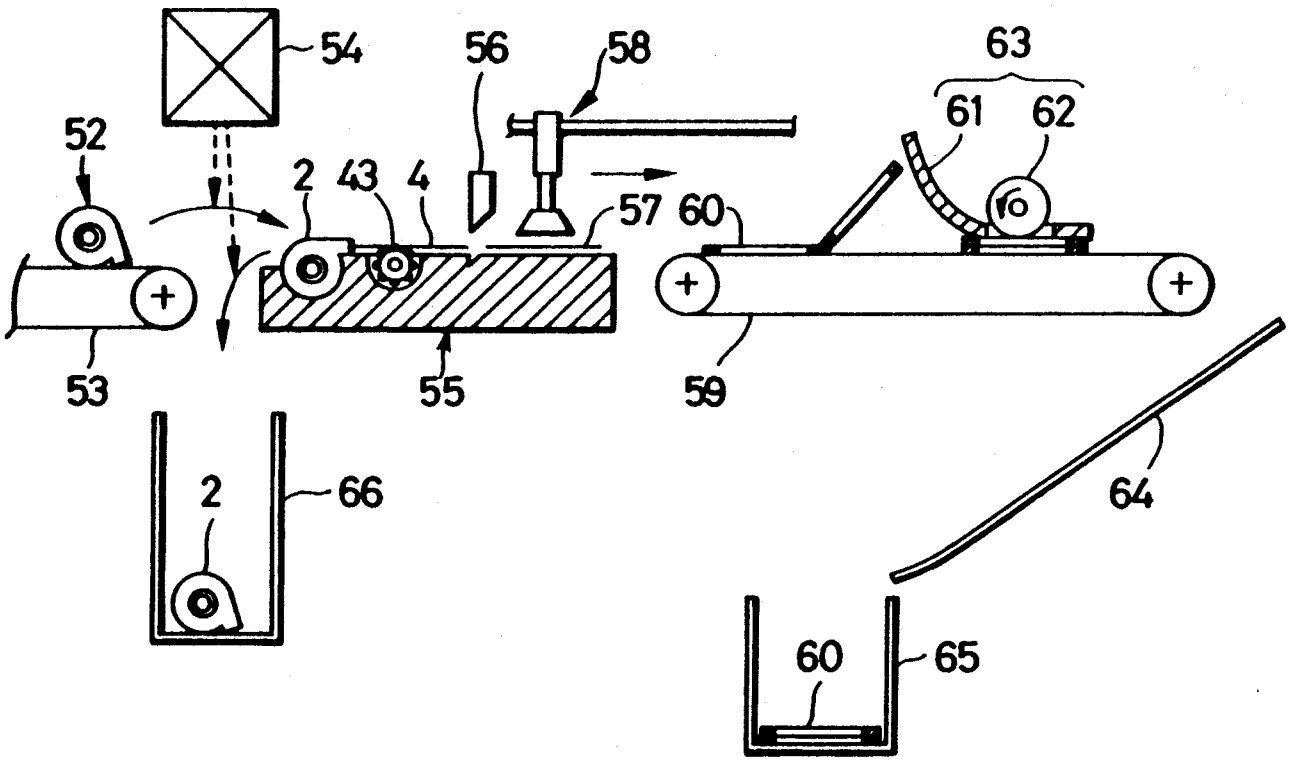
FIG. 5 is a schematical view illustrating a slide-mounting processing machine for processing the film cassette illustrated in FIG. 1.

Referring to the cassette shell 2 containing reversal film as the photographic film 4, the reversal film is subjected to a slide-mounting process after a reversal film developing process. In FIG. 5, illustrating a system for the slide-mounting process, the reversal film 4 after development is wound up in the cassette shell 2, which is conveyed by a conveyer belt 53 is as a film cassette 52 in a manner similar to negative film.

The film cassette 52 at a predetermined position is transported by a transporter 54 to a cassette holder 55, which is provided with a spool rotating device 32 (FIG. 3) and a sprocket 43 in the same manner as the cassette holder 41 of the printer-processor. The leading end portion 4a is initially advanced outside the cassette by the spool rotating device 32. The reversal film 4 is then drawn out by the sprocket 43 frame by frame, and cut by a cutter to be respectively separate film pieces 57 of one frame, which are raised by a transporter 58 having a suction cup and placed on a slide mount 60 supplied on a conveyer belt 59. The slide mount 60 is successively supplied to the conveyer belt 59. The slide mount 60, with the film piece 57 placed thereon, is then conveyed to a mounter 63 constituted of a guide member 61 and a pressing roller 62. Specifically, the slide mount 60 is conveyed to the mounter 63 in an open state, folded in two by the guide member 61, pressed by the pressing roller 62 so as to integrate the film piece 57 with the slide mount 60 inside, and dropped on a passage 64 to be stored in a receiving case 65. When the film piece of the final image frame has been subjected to the slide-mounting process, the transporter 54 takes up the emptied cassette shell 2 from the cassette holder 55 and drops it into a receiving box 66. The cassette shell 2, made from plastic, is thrown away as industrial waste, but can be reused by melting it into pellets.

The system as described above is such that either the printing process or the slide-mounting process is effected in a manner continuous with the process of developing the exposed film 4. However, the present invention is applicable to a system where the film cassette after a developing process is subjected either to a printing process or a slide-mounting process in a machine installed in a manner completely separate from a film processor. It is possible for such a system to use a printer or a slide-mounting machine of types different from the herein-described embodiment in order to meet any specified purposes.

Figure 6:
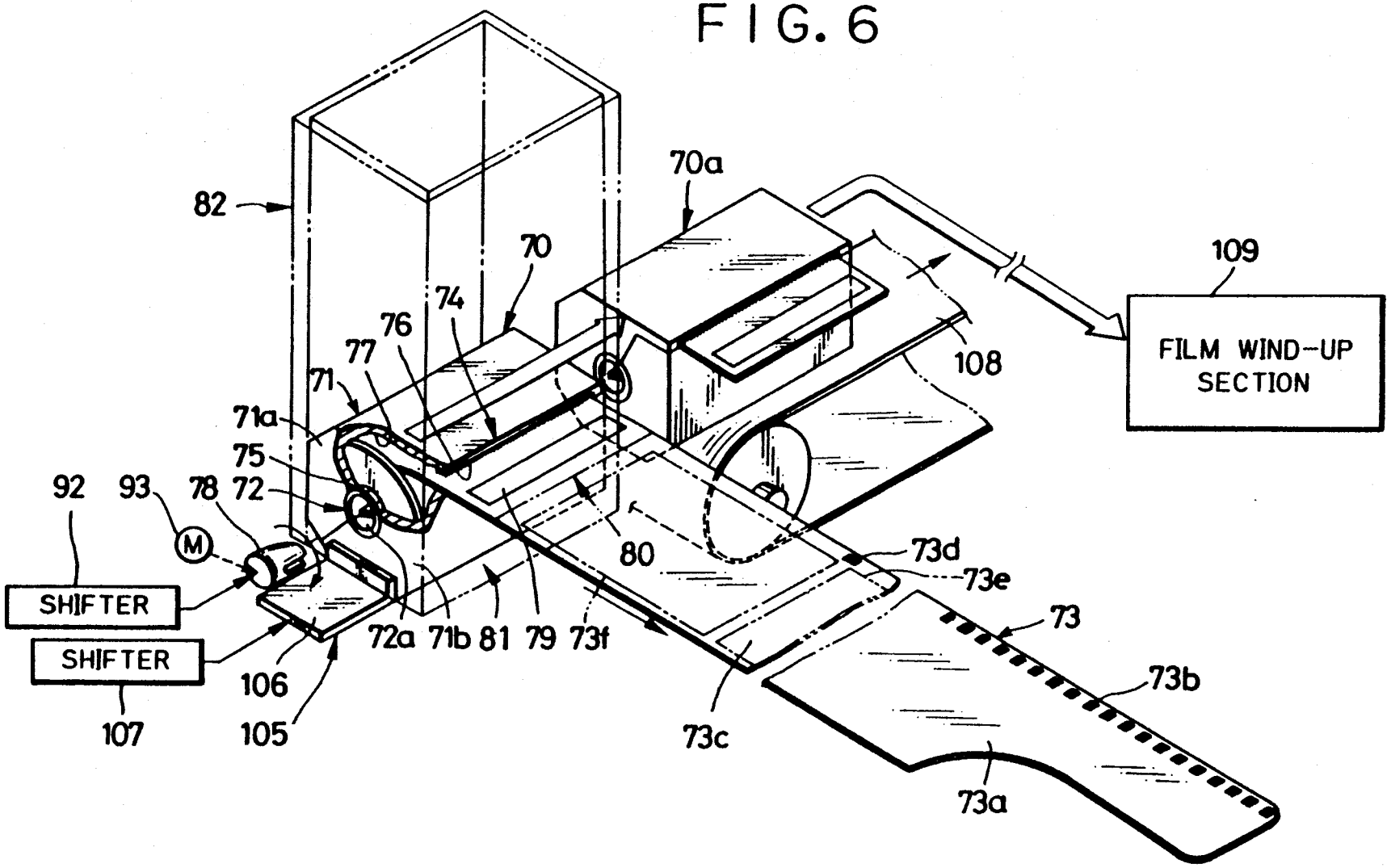
FIG. 6 is perspective view illustrating a film being drawn-out from the cassette in a film processor for use according to another preferred embodiment, and a film cassette positioned therein.

Another preferred embodiment is now described in which exposed photographic film is separated from a cassette shell, developed, and contained in an original cassette shell as a developed film preserving cassette with reference to FIG. 6. A photographic film cassette 70 is constituted of a cassette shell 71, a spool 72 rotatably supported in the cassette shell 71, and photographic film 73 wound about the spool 72 With the film trailer fixed thereon.

The cassette shell 71 is formed in the shape of a prism including joined shell halves 71*a* and 71*b* molded from synthetic resin, and provided with a film passage mouth 74 for passing the photographic film 73 and openings 75 for supporting the spool 72 and for exposing a coupling end 72*a* to the outside. A plush or light shielding fabric 76 is attached to the film passage mouth 74. A film containing chamber 77 defined inside the cassette shell 71 has an internal diameter substantially equal to the maximum diameter of the photographic film 73 as wound about the spool 72. When the spool 72 is rotated in the film unwinding direction by inserting a fork 78 in the coupling end 72*a*, a leading end of the photographic film 73 is guided by the inside surface of the film containing chamber 77 and advanced to the outside of the film passage mouth 74. It is noted that the film cassette 71 is shaped as a box-like prism for increasing its stability at the time when a plurality of film cassettes are lapped one over another, but may be cylindrical such as a conventional film cassette.

A film leader 73*a* has one lateral side cut off, as well-known in the art, for reducing the resistance to feeding the photographic film 73 when advancing the film leader 73*a* toward a take-up spool in a camera. The lateral side of the film leader 73*a* opposite to the cut side is provided with perforations 73*b* which are engaged by a film threading member of the camera for feeding the film leader 73*a* to the take-up spool after being drawn out of the cassette shell 71. A film main portion 73*c* of the photographic film 73 is provided with positioning perforations 73*d*, one for each of the image frames 73*e*, which can be detected mechanically or optically in order to position each of the image frames 73*e* on an aperture of the camera.

On the photographic film 73 fully drawn out of the cassette shell 71, a hot-melt adhesive area 79 is formed between a final image 73*f* and the spool 72 on a back surface opposite to the photosensitive emulsion surface of the photographic film 73. When all of the exposed film 73 is drawn out of the cassette shell 71 for development, the exposed film 73 is cut along a line between the final image frame 73*f* and the hot-melt adhesive area 79 such that the hot-melt adhesive area 79 remains attached to the cassette shell 71. The cutting line 80 is indicated by the two-dot-dash line in FIG. 6. The portion of the film trailer left on the cassette shell 71 is used as a connecting sheet for connecting the exposed film 73 after development to the spool 72. It is noted that the hot-melt adhesive area 79 may be formed on the photosensitive emulsion surface or on both surfaces of the photographic film 73. When both surfaces are provided with an adhesive area, efficiency in the developing process is improved because either adhesive area may be used for connecting the developed film 73.

Figure 7:
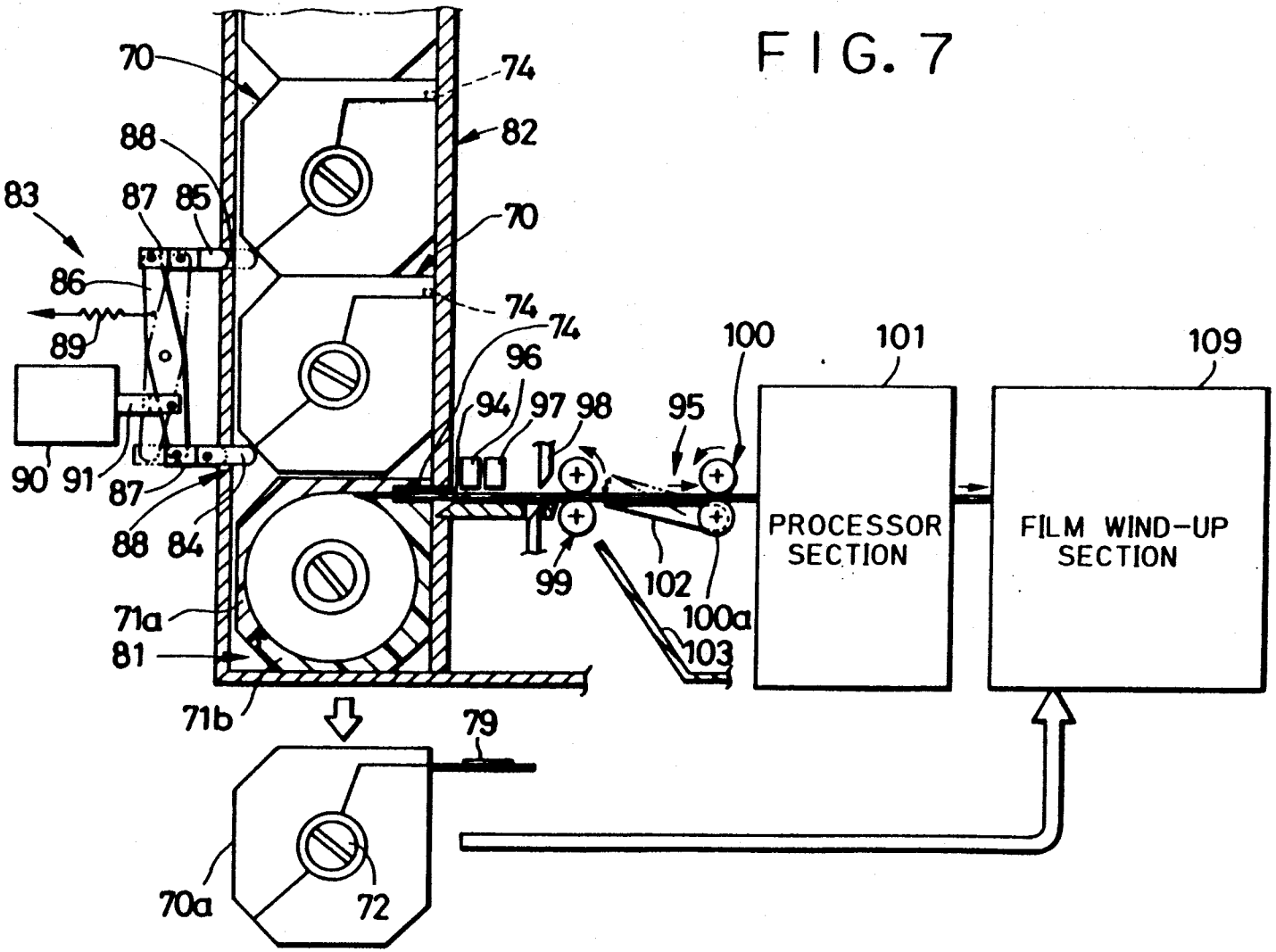
FIG. 7 is a schematical view illustrating a film feeding section of the film processor illustrated in FIG. 6.

In FIG. 7, illustrating a film processor for developing the photographic film 73 exposed by loading the film cassette 70, a cassette holder 82 is formed in the shape of a rectangular elongate box, in which a plurality of film cassettes are contained with their film passage mouth 74 directed in the same direction. The lower portion of the cassette holder 82 is provided with a cassette feeding mechanism 83 which includes lower and upper stopper pins 84 and 85 for retractably projecting into the cassette holder 82. The stopper pins 84 and 85 are pivotably supported on both ends of an arm 86 by means of connecting members 87, and project alternately into the cassette holder 82 through guide holes 88 in correspondence with displacement of the arm 86. A coiled spring 89 biases the arm 86 so that the lower stopper pins 84 project into the cassette holder 82.

A solenoid 90 is connected to the arm 86 by means of a plunger 91, and displaces the arm 96 in order to alternately project the stopper pins 84 and 85. A single film cassette positioned between the lower and upper stopper pins 84 and 85 drops to a film pull stage 81. After the film cassette drops, the solenoid 90 is deenergized to return the arm 86 to the home position, indicated by the solid line, by means of the coiled spring 89. Of course it is understood that instead of using the stopper pins linked by the arm 86 to position the film cassette 70 alone, the stopper pins may be driven separately by using two solenoids or the like.

As illustrated in FIG. 6, the film pull stage 81 is provided with the fork 78 slidable in the axial direction of the spool 72. A shifter 92 shifts the fork 78 in the axial direction to displace it from a retracted position to a position for engaging the fork 78 with a coupling end 72*a* of the spool 72. After the fork engages the coupling end 72*a*, a motor 93 rotates to rotate the spool 72 in the unwinding direction to advance the film leader 73*a* outside of the film cassette 70.

As illustrated in FIG. 7, a feeding passage 95 is formed adjacent a film passage mouth 94 of the film pull stage 81, and is provided with a leading end sensor 96, a sensor 97 for detecting the hot-melt adhesive area 79, a cutter 98, a pair of drawing rollers 99 and a pair of feeding rollers 100 successively disposed. The leading end sensor 96 detects the film leader 73*a* fed in the feeding passage 95. The drawing rollers 99 then begin to rotate to feed the exposed film 73 to the feeding rollers 100. The rotation of the drawing rollers 99 and the feeding rollers 100 is controlled to provisionally reverse a predetermined length of film in the shape of a loop between the drawing and feeding rollers 99 and 100 in preparation for being cut by the cutter 98. After forming such a loop, the exposed film 73 is fed to a processor section by the drawing and feeding rollers 99 and 100.

The cutter 98 cuts the film between the leader 73*a* and the main portion 73*c* in a straight line to separate the film main portion 73*c* from the leader 73*a*, and cuts the film so as to separate the main portion 73*c* of the film from the cassette after drawing all of the exposed film 73 out of the cassette shell 71. In more detail, a guide plate 102 is provided coaxially with a lower drawing roller 100*a* of the drawing rollers 100 for pivoting upward in order to guide the cut-off film leader toward a throwaway passage 103. The guide plate 102 returns to the initial downward position after throwing away the film leader, and guides the front end of exposed film 73 toward the drawing rollers 100.

The sensor 97 optically detects the adhesive area 79 on the film trailer of the exposed film 73. The drawing rollers 99 stop rotation upon detection of the adhesive area 79. The cutter 98 is then actuated to cut the exposed film 73 along the virtual cutting line 80 in front of the hot-melt adhesive area 79 so as to separate the exposed film 73 from the cassette shell 71. The length of film reserved as a loop between the drawing rollers 99 and the feeding rollers 100 decreases during the film cutting process, so that the exposed film 73 is incessantly fed into the processor section 101. Although the film trailer is detected by detecting the adhesive area 79 in the present embodiment, it may be alternatively detected by detecting a displacement of the cassette shell or a tension of drawing the exposed film in the feeding direction when drawing out the entire film.

Referring to FIG. 6, a cassette ejecting mechanism 105 is constituted of an ejecting bracket 106 and a shifter 107 for shifting the ejecting bracket 106 in the axial direction of the spool 72. The ejecting mechanism ejects an emptied cassette shell 70*a* separated from the exposed film 73 to shift it from the film pull stage 81 to a cassette conveyer 108, which consists of conveyer belts for conveying the emptied cassette shell 70*a* to a film wind-up section 109.

Figure 8:
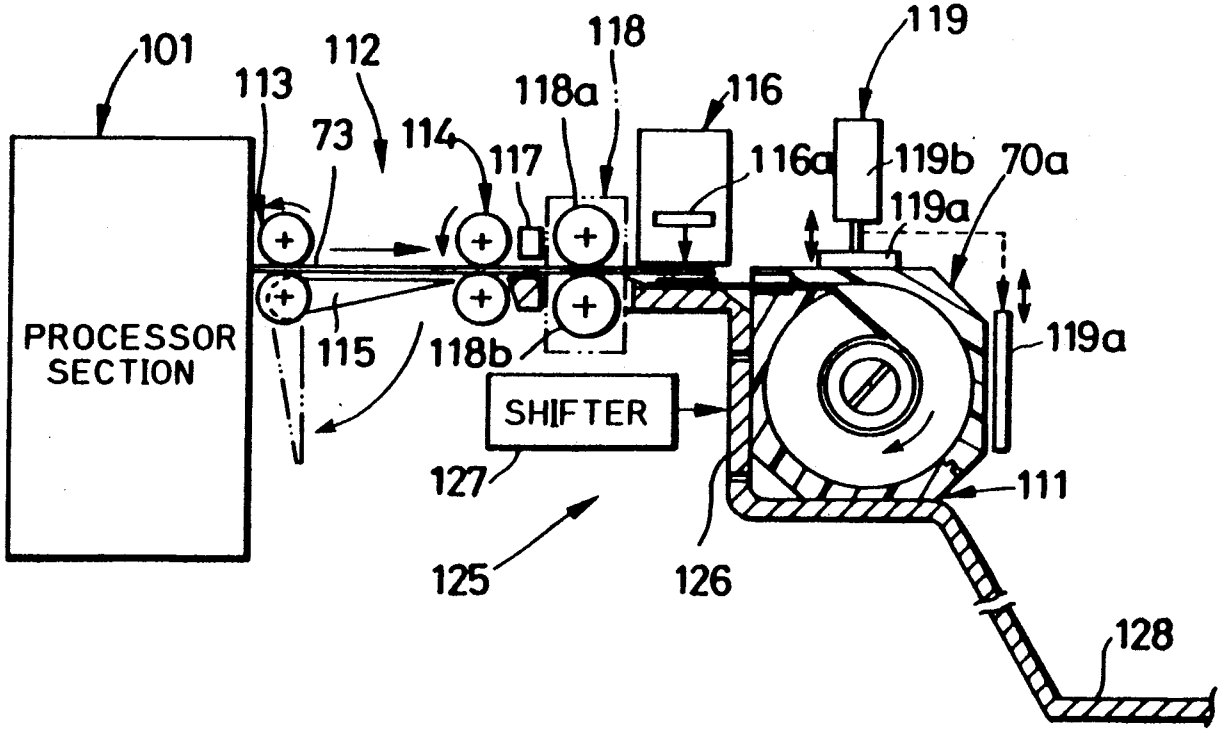
FIG. 8 is a schematical view illustrating a film wind-up section of the film processor illustrated in FIG. 6.
Figure 9:
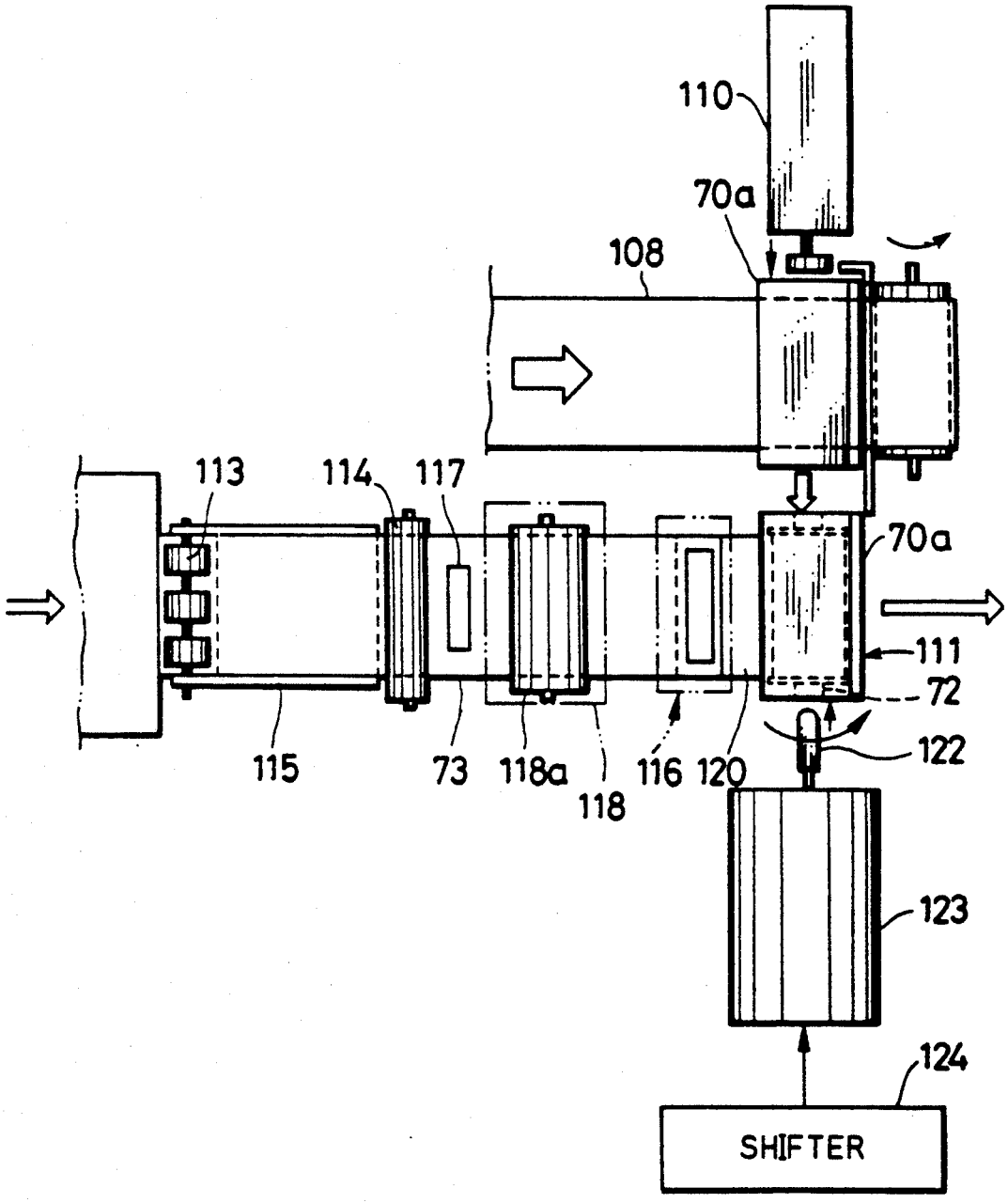
FIG. 9 is a plan view illustrating the film wind-up section illustrated in FIG. 8.
Figure 10:
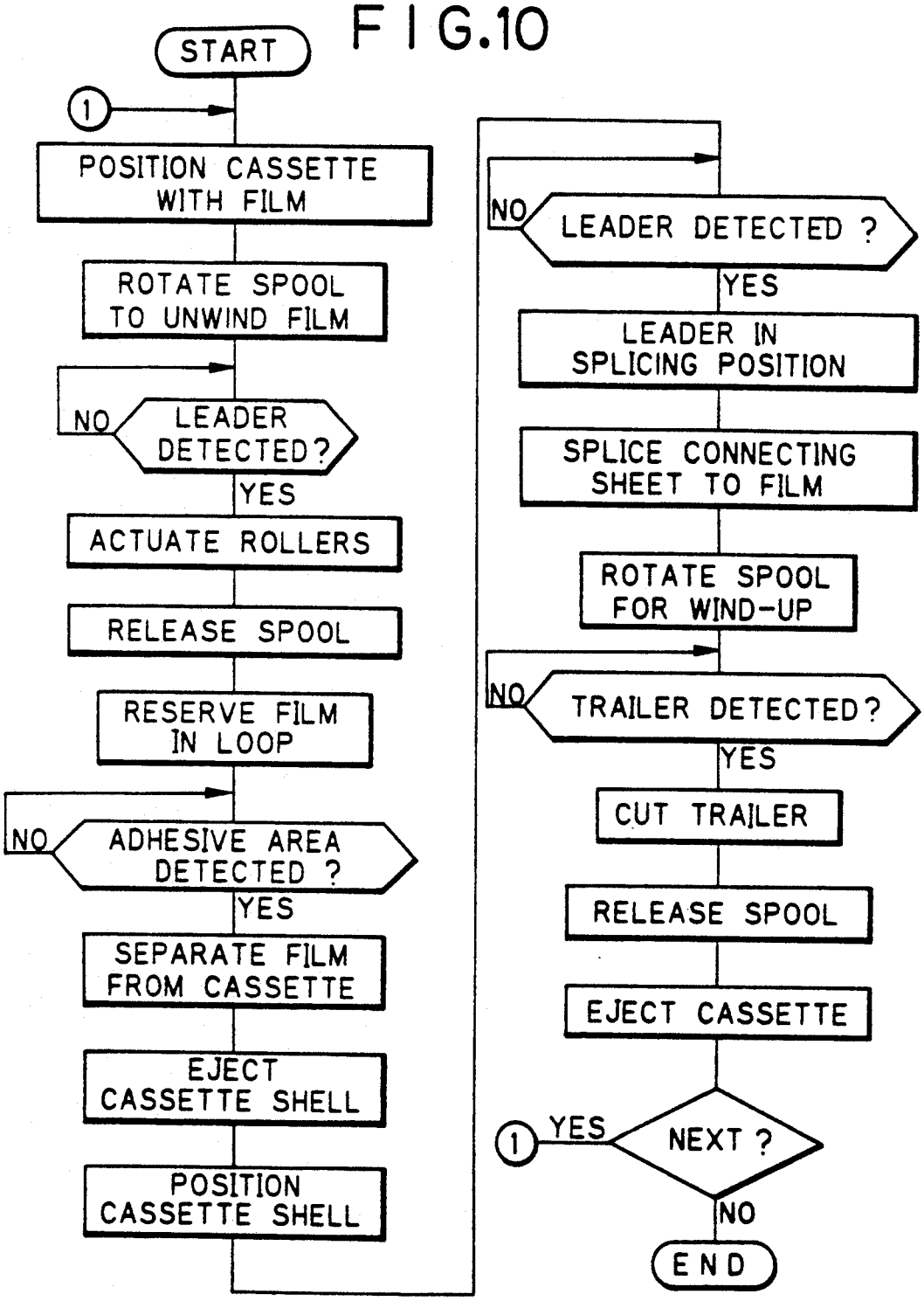
FIG. 10 is a flowchart schematically illustrating a photographic film handling method by use of the film processor illustrated in FIG. 6.

In FIGS. 8 to 10, the film wind-up section 109 is disposed in a position downstream from the film processor 101, and winds up the developed film 73 into the emptied cassette shell 70*a* positioned in the film wind-up stage 111. As illustrated in FIG. 9, the cassette conveyer 108 film wind-up stage 111. The emptied cassette shell 70*a* conveyed to an end of the cassette conveyer 108 is shifted by a cassette shifting mechanism 110 toward the film wind-up stage 111.

Referring to FIG. 8, the outlet of the processor section 101 is provided with a film reservoir 112 which consists of two pairs of feeding rollers 113 and 114 and a pivotable guide plate 115. The guide plate 115 guides the front end of the developed film 73 out of the processor section 101 toward the feeding rollers 114 disposed in the downstream position of the film reservoir 112, and downwardly pivots to form a spacing for a loop of film. The reservoir 112 reserves the developed film 73 in the shape of a loop between the feeding rollers 113 and 114 by stopping rotation of the feeding rollers 114 for the time of a subsequent process, such as splicing the developed film 73 in a splicing unit 116.

A film end sensor 117, a rotary cutter 118, the splicing unit 116 and a cassette supporting unit 119 are successively disposed on the side downstream from the feeding rollers 114. The film end sensor 117 detects the front end and the film trailer of the developed film 73, generates a front end detecting signal, according to which the feeding roller 114 positions the front end of the developed film 73 in the splicing position of the splicing unit 116, and generates a film trailer detecting signal, according to which the rotary cutter 118 cuts off the film trailer in a predetermined shape. A pair of rolled cutting edges 118*a* and 118*b* are provided on the peripheral surfaces of the rotary cutter 118. The diameter of each circumference is determined so as to be suitable for cutting the film trailer, though the diameter is illustrated as being relatively small in the drawings. The rotary cutter 118 thereby cuts the film trailer to have a smaller width in a manner similar to that of the film leader 73*a* before developing the exposed film 73 as illustrated in FIG. 6. This facilitates the advance of a new free end of the film toward the outside of the cassette shell and reduce its resistance to the plush 76.

The splicing unit 116 is provided with a thermal head 116*a* for melting the layer in the hot-melt adhesive area 79 on a connecting sheet 120 of the emptied cassette shell 70*a* so as to adhere the connecting sheet 120 to the front end of the developed film 73. The cassette supporting unit 119 consists of two supporting plates 119*a* and a solenoid 119*b* for shifting the supporting plates 119*a* up and down, and supports the emptied cassette shell 70*a* in a fixed position during winding up of the developed film 73. Additionally the support unit 119 releases the emptied cassette shell 70*a* from being supported after the film has been wound up.

As illustrated in FIG. 9, a rotary shaft 122 rotates the spool 72 in the direction of winding up the developed film 73 to contain the developed film 73 in the emptied cassette shell 70*a* in a roll. The rotary shaft 122 is constituted of a motor 123 and a shifter 124 in the same manner as the fork 78 for drawing out the exposed film 73. The shifter 124 inserts the rotary shaft 122 in the coupling end 72*a* of the spool 72. The motor 123 rotates the spool 72 in the film wind-up direction so as to wind up the developed film 73 in the emptied cassette shell 70*a*. A cassette ejector 125 consists of an ejecting bracket 126 and a shifter 127 for ejecting the cassette shell with the developed film 73 wound up therein from the film wind-up stage 111 toward a receiving tray 128.

The operation of the present embodiment is now described with reference to a flowchart illustrated in FIG. 10. The film cassette 70 is first inserted in the cassette holder 82 as illustrated in FIG. 7. A plurality of film cassette are lapped one over another in the cassette holder 82 in a state retained by the lower stopper pins 84. The solenoid 90 of the cassette feeding mechanism 83 is actuated so that the single film cassette 70 between the stopper pins 84 and 85 is positioned in the film pull stage 81. The fork 78 is axially shifted by the shifter 92 as illustrated in FIG. 6. While the fork 78 is coupled with the coupling end 72*a*, the motor 93 is rotated to rotate the spool 72 in the unwinding direction to advance the film leader 73*a*. The exposed film 73, with the film leader 73*a* advanced, is fed along the feeding passage 95 as illustrated in FIG. 7. The film leader 73*a* is cut by the cutter 98 transverse to the film resulting in a straight front end, from which the separated film leader is thrown away. The rotation of the drawing and feeding rollers 99 and 100 is controlled in order to reserve the exposed film 73 in the form of a loop at a length corresponding to the time necessary for cutting the film trailer by using the rotary cutter 118, and then to feed the exposed film 73 into the processor section 101.

When the entire length of the exposed film 73 has been drawn out of the cassette shell 71 during development, the hot-melt adhesive area 79 is detected by the sensor 97, which generates a detecting signal to actuate the cutter 98, which cuts the exposed film 73 in front of the hot-melt adhesive area 79. After cutting the exposed film 73 away from the cassette shell 71, the cassette shell 71 or the emptied cassette shell 70*a* is ejected from the film pull stage 81 to the cassette conveyer 108 by the cassette ejecting mechanism 105. The emptied cassette shell 70*a* is fed to the film wind-up stage 111 in the film wind-up section 109 by the cassette conveyer 108 and the cassette shifting mechanism 110.

After developing the exposed film in the processing section 101 as illustrated in FIG. 9, the front end of the film is fed along the pivotable guide plate 115 up to the splicing unit 116, and is positioned in the splicing position in accordance with a front end detecting signal generated from the film and detecting sensor 117. The front end is adhered to the connecting sheet 120 of the emptied cassette shell 70*a* in the splicing unit 116 by use of the hot-melt adhesive area 79.

The spliced developed film is then wound up into the emptied cassette shell 70*a* by rotating the rotary shaft 122. When further wind-up causes detection of the film trailer on the film end sensor 117, the film trailer is cut in the same shape as the film leader 73*a* illustrated in FIG. 6, and then wound up in the cassette shell 70*a*. Thereafter, the cassette shell 70*a* is ejected from the film wind-up stage 111 by the cassette ejecting mechanism 125 while retracting the supporting plates 119*a*. Another emptied cassette shell 70*a* is then positioned in the film wind-up stage 111 in a similar manner. The same process of development is repeated. A developed film is wound up and contained in the cassette shell 70*a*. Because the film trailer is treated as described above and contained in the cassette shell 70*a* as a newly free end of the developed film on the outermost turn of the roll, this free end can be easily advanced outside the film cassette at the following printing process.

Figure 11:
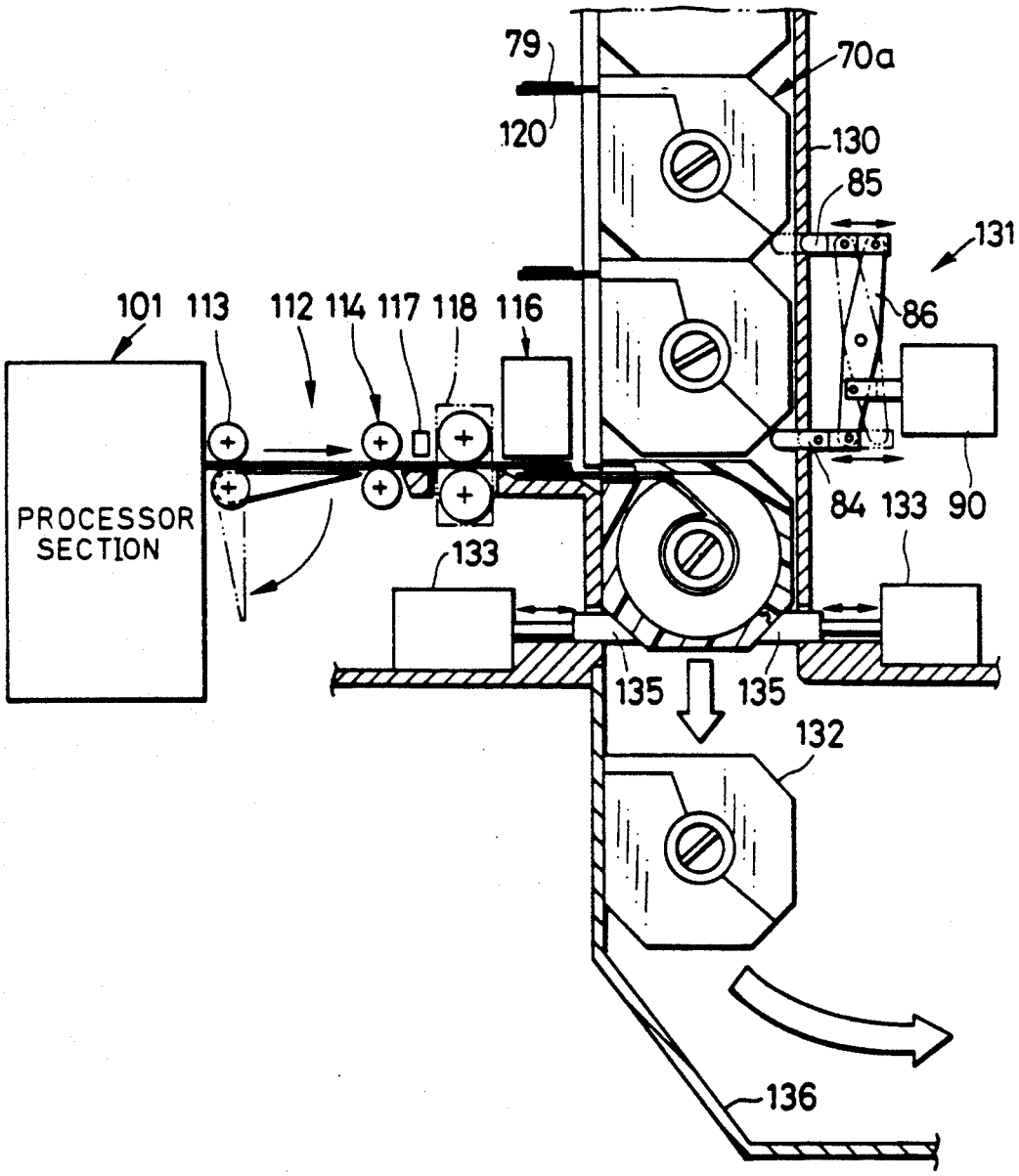
FIG. 11 is a schematical view illustrating a film wind-up section for use according to a further preferred embodiment.

It is noted that, although an originally used film cassette is conveyed to the film wind-up stage and is used for containing the developed film, a great number of emptied cassette shells 70*a* may be prepared, or beforehand collected, and stored in a cassette holder 130 so as to be fed one by one on a film wind-up stage, for which a cassette feeding mechanism 131, of a construction the same as the mechanism 83, is provided in the cassette holder 130. Stopper pins 135 are formed on a solenoids 133, and are retracted from the cassette holder 130 by actuating the solenoids 133 so as to discard a cassette shell 132 containing the developed film toward a receiving tray 136. Elements similar to those in the above embodiment is designated with identical reference numerals in FIG. 11.

Figure 12:
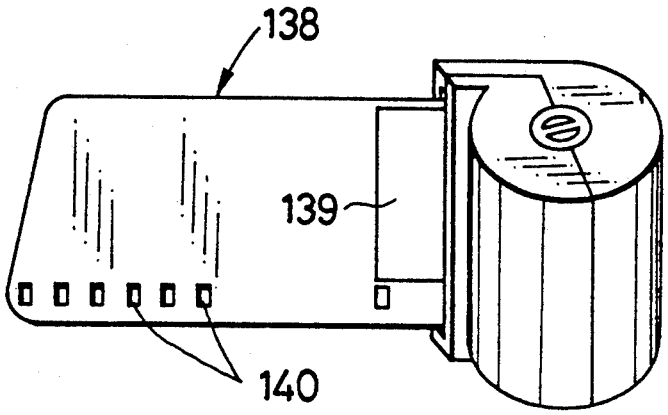
FIG. 12 is a perspective view illustrating a shape in which a film trailer of the photographic film is cut according to yet another preferred embodiment.

Although the film trailer is cut into the same shape as the film leader before development by the rotary cutter 118, a developed film 138 may be cut in an oblique fashion as illustrated in FIG. 12. It is preferably for this construction to form additional perforations 140 on the same rear end portion up to the vicinity of a last image frame 139 in order to reliably advance a new free end of the developed film 138 from the cassette shell to its outside. It is thereby possible for drawing the exposed film out of the cassette shell to use a single-toothed sprocket provided in the printer for rotating in the initial step of drawing-out, which makes it more reliable to initially advance the film leader in operative combination with the unwinding rotation of the spool for drawing out the film leader. It is also noted that a plush may be preferably removably attached to the cassette shell, because it is unnecessary to contain the developed film in light-tight fashion unlike unexposed film or exposed film before development. It is preferable to remove the plush from the cassette shell by pulling it therefrom after drawing out the exposed film, so that load against advancing a new free end of the developed film from inside the cassette shell can be reduced.

Although the embodiment illustrated in FIGS. 6 to 12 is applied to a film cassette in which rotation of the spool can cause a film end to advance to the outside, it may be applied to a conventional film cassette. Although the exposed film is individually drawn out of the film cassette 70 and guided to the processor section 101, a guiding leader sheet may be attached to the film leader advanced outside, in order to guide the exposed film to respective processing tanks. The leader sheet is preferably separated before attaching the developed film to the connecting sheet.

Although applied to a film processor, the present embodiment may be applied to a photofinishing machine with a printer connected to a film processor. Instead of using a film portion attached to the spool as connecting sheet, a sheet specialized for connection may be attached to the spool 73 and the film trailer of the photographic film 73. Although the developed film 73 is attached to the connecting sheet 120 of the cassette shell 70*a* by use of the hot-melt adhesive area 79, the developed film may be attached thereto with splice tape or the like.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A method for handling a photographic film cassette for still picture photography including a single cassette shell, a spool contained in said cassette shell and an exposed photographic film wound about said spool with a film trailer attached thereto, of which spool rotation in a direction of unwinding said exposed film causes a film leader, being attached at one end to said film and being unattached at another end, to advance at least said another end outside of said cassette shell, said handling method comprising the steps of:

rotating said spool in said unwinding direction in order to advance said film leader out of said cassette shell; and thereafter drawing said exposed film out of said cassette shell for developing said exposed film in a state with said film trailer attached to said spool so as to allow said cassette shell to be reused.

2. A photographic film cassette handling method as defined in claim 1, wherein said rotating step comprises rotating said spool using a spool rotating device incorporated in a film processor.

3. A photographic film cassette handling method as defined in claim 2, wherein said film drawing step includes the steps of clamping said film leader with a catcher provided with said film processor; and thereafter displacing said catcher from said cassette shell in a direction to increase a distance between said catcher and said cassette shell.

4. A photographic film cassette handling method as defined in claim 1, further comprising the steps of:

winding up said exposed film into said cassette shell after development;

rotating said spool in said unwinding direction in a printer in order to advance said film leader out of said cassette shell;

drawing said developed film out of said cassette shell frame by frame after advancing said film leader for subjecting said developed film to printing in a printer in a state with said film trailer attached to said spool; and rotating said spool in a direction of winding up said developed film after printing for containing said developed film in said cassette shell.

5. A photographic film cassette handling method as defined in claim 4, wherein said spool rotating steps include the step of rotating said spool using a spool rotating device incorporated in said printer.

6. A photographic film cassette handling method as defined in claim 5, wherein said film drawing out step is carried out by rotating a sprocket provided in said printer.

7. A photographic film cassette handling method as defined in claim 1, further comprising the steps of:

rotating said spool in a direction of winding up said exposed film after development for containing said exposed film in said cassette shell;

rotating said spool in said unwinding direction in a slide-mounting machine in order to advance said film leader out of said cassette shell; and drawing said developed film out of said cassette shell frame by frame for cutting said developed film into respective film pieces of image frames created on said developed film so as to mount said film pieces on slide mounts.

8. A photographic film cassette handling method as defined in claim 7, wherein said spool rotating steps comprises rotating said spool with a spool rotating device incorporated in said slide-mounting machine.

9. A photographic film cassette handling method as defined in claim 8, wherein said frame-by-frame film drawing-out step is carried out by rotating a sprocket provided in said slide-mounting machine.

10. A method for handling a photographic film cassette including a cassette shell, a spool contained in said cassette shell and a developed photographic film wound about said spool with a film trailer attached thereto, of which spool rotation in a direction of unwinding said developed film causes a film leader to advance to an outside of said cassette shell, said handling method comprising the steps of:

rotating said spool in said unwinding direction in a printer in order to advance said film leader out of said cassette shell;

drawing said developed film out of said cassette shell frame by frame after advancing said film leader for subjecting said developed film to printing in a state with said film trailer attached to said spool; and rotating said spool in a direction of winding said developed film into said cassette shell such that said developed film is contained within said cassette shell.

11. A photographic film cassette handling method as defined in claim 10, wherein said rotating steps comprise rotating said spool using a spool rotating device incorporated in said printer.

12. A photographic film cassette handling method as defined in claim 11, wherein said film drawing-out step is carried out by rotating a sprocket provided in said printer.

13. A photographic film cassette handling method as defined in claim wherein said developed film is handled in development in the steps of:

rotating said spool in said unwinding direction for advancing said film leader of said photographic film out of said cassette shell after exposure;

drawing out said photographic film until drawing a first end of a connecting sheet out of said cassette shell, said connecting sheet beforehand being wound on said spool together with said photographic film in a state with said first end connected to said film trailer and with an opposite second end fixed on said spool in order to connect said photographic film to said spool;

separating said photographic film from said connecting sheet for development;

connecting said photographic film after development to said first end of said connecting sheet drawn out of said cassette shell; and rotating said spool in said winding-up direction for containing said developed film in said cassette shell together with said connecting sheet.

14. A photographic film cassette handling method as defined in claim 13, wherein said spool rotating steps comprise rotating said spool using a spool rotating device incorporated in a film processor.

15. A photographic film cassette handling method as defined in claim 14, wherein said film drawing-out step is carried out by nipping said photographic film with a pair of rollers incorporated in said film processor and rotating said rollers.

16. A photographic film cassette handling method as defined in claim 14, wherein said connecting step comprises splicing said first end of said connecting sheet to said film leader after development.

17. A photographic film cassette handling method as defined in claim 16, further comprising the step of conveying said cassette shell after said shell has been separated from said photographic film for development to a position where said film leader is to be spliced to said connecting sheet.

18. A photographic film cassette handling method as defined in claim 16, further comprising the steps of:

repeating said separating step for a plurality of photographic films;

conveying a plurality of cassette shells separated from said plurality of photographic films during development to a position where film leaders of said plurality of photographic films are to be positioned for splicing after development; and providing one of said plurality of cassette shells to said developed film for performing said connecting step.

19. A photographic film cassette handling method as defined in claim 16, wherein said film trailer is beforehand attached directly to said spool, said photographic film drawn out is cut outside said cassette shell, and a remainder of said film trailer thereby remaining on said cassette shell is used for said connecting sheet.

20. A photographic film cassette handling method as defined in claim 19, further comprising the step of providing a hot-melt adhesive area on said trailer remainder in a vicinity of an end thereof, said film leader being thereby spliced to said trailer remainder.

21. A photographic film cassette handling method as defined in claim 20, further comprising the step of cutting said film trailer so as to reduce a width between two lateral sides thereof before winding up said film trailer in said cassette shell when containing said developed film in said cassette shell in order to facilitate an advance of said film trailer toward an outside of said cassette shell in a state where said developed film is wound up in said cassette shell with said film trailer wound outside thereabout.

22. A photographic film cassette handling method as defined in claim 20, further comprising the step of cutting said film trailer so as to form an oblique end before winding up said film trailer in said cassette shell when containing said developed film in said cassette shell in order to facilitate an advance of said film trailer toward an outside of said cassette shell in a state where said developed film is wound up in said cassette shell with said film trailer wound outside thereabout, and provided with perforations perforated along one lateral side for said advance toward an outside.

23. A method for handling a photographic film cassette including a cassette shell, a spool contained in said cassette shell and an exposed photographic film wound about said spool with a film trailer attached thereto, of which spool rotation in a direction of unwinding said exposed film causes a film leader to advance to an outside of said cassette shell, said handling method comprising the steps of:

rotating said spool in said unwinding direction in order to advance said film leader out of said cassette shell;

drawing said exposed film out of said cassette shell after advancing said film leader for developing said exposed film in a state with said film trailer attached to said spool;

winding up said exposed film into said cassette shell after development;

rotating said spool in said unwinding direction in a printer in order to advance said film leader out of said cassette shell;

drawing said exposed film out of said cassette shell frame by frame after advancing said film leader for subjecting said exposed film to printing in a state with said film trailer attached to said spool; and rotating said spool in a direction of winding up said exposed film after printing for winding said exposed film in a roll in order to use said cassette shell for containing said exposed film after development.

24. A method for handling a photographic film cassette including a cassette shell, a spool contained in said cassette shell and an exposed photographic film wound about said spool with a film trailer attached thereto, of which spool rotation in a direction of unwinding said exposed film causes a film leader to advance to an outside of said cassette shell, said handling method comprising the steps of:

rotating said spool in said unwinding direction in order to advance said film leader out of said cassette shell;

drawing said exposed film out of said cassette shell after advancing said film leader for developing said exposed film in a state with said film trailer attached to said spool;

rotating said spool in a direction of winding up said exposed film after printing for winding said exposed film in a roll in order to use said cassette shell for containing said exposed film after development.

rotating said spool in said unwinding direction in a slide-mounting machine in order to advance said film leader out of said cassette shell; and drawing said exposed film out of said cassette shell frame by frame for cutting said exposed film into respective film pieces of image frames created on said exposed film so as to mount said film pieces on slide mounts.

25. A method for handling a photographic film cassette including a cassette shell, a spool rotatably contained in said cassette shell, an exposed photographic film wound about said spool, and a connecting sheet beforehand being wound on said spool together with said exposed film in a state with a first end connected to a film trailer of said exposed film and with an opposite second end fixed on said spool in order to connect said exposed film to said spool, said handling method comprising the steps of:

drawing out said exposed film until drawing said first end of said connecting sheet out of said cassette shell;

separating said exposed film from said connecting sheet for development;

connecting said exposed film after development to said first end of said connecting sheet drawn out of said shell; and rotating said spool in a direction of winding up said exposed film for winding said exposed film with said connection sheet in a roll in order to use said cassette shell for containing said exposed film after development.

26. A photographic film cassette handling method as defined in claim 25, wherein said film trailer is beforehand attached directly to said spool, said exposed film drawn out is cut outside said cassette shell, and a trailer remainder of said film trailer thereby remaining on said cassette shell is used for said connecting sheet.

* * * * *